US007819226B2

(12) United States Patent
Sumimoto

(10) Patent No.: US 7,819,226 B2
(45) Date of Patent: Oct. 26, 2010

(54) SUPPRESSING METHOD OF WEAR IN FRICTION SYSTEM BETWEEN TWO OBJECTS

(75) Inventor: Morio Sumimoto, Yokohama (JP)

(73) Assignee: Sumimoto Scientific Institute Co., Ltd., Yokosuka-Shi (JP)

( * ) Notice: Subject to any disclaimer, the term of this patent is extended or adjusted under 35 U.S.C. 154(b) by 1300 days.

(21) Appl. No.: 10/546,588

(22) PCT Filed: Oct. 4, 2004

(86) PCT No.: PCT/JP2004/014597

§ 371 (c)(1),
(2), (4) Date: Aug. 23, 2005

(87) PCT Pub. No.: WO2005/033575

PCT Pub. Date: Apr. 14, 2005

(65) Prior Publication Data

US 2006/0151246 A1 Jul. 13, 2006

(30) Foreign Application Priority Data

Oct. 6, 2003 (JP) ..... 2003-346763
Sep. 3, 2004 (JP) ..... 2004-257339

(51) Int. Cl.
*F16N 39/00* (2006.01)

(52) U.S. Cl. ..... 184/6.21

(58) Field of Classification Search ..... 184/6.21
See application file for complete search history.

(56) References Cited

U.S. PATENT DOCUMENTS 4,435,287 A * 3/1984 Sumimoto ..... 210/131
5,067,455 A * 11/1991 Okajima et al. ..... 123/196 R
5,198,129 A 3/1993 Hata
5,872,310 A * 2/1999 Sumimoto ..... 73/53.05

FOREIGN PATENT DOCUMENTS

| | | |
|---|---|---|
| JP | 03-031746 | 2/1991 |
| JP | 03-078513 | 4/1991 |
| JP | A-3-227398 | 10/1991 |
| JP | U-4-123316 | 11/1992 |
| JP | 05-296926 | 11/1993 |
| JP | 07-063035 | 3/1995 |

(Continued)

*Primary Examiner*—Robert A Siconolfi
*Assistant Examiner*—James K Hsiao
(74) *Attorney, Agent, or Firm*—Oliff & Berridge, PLC

(57) ABSTRACT

An object of the invention is to provide a system for suppressing a wear due to a friction of a friction system between two objects, particularly suppressing a wear due to a friction between a cylinder and a piston in an internal combustion engine to the minimum, increasing a reliability of the internal combustion engine to the maximum, and extending an interval of an overhaul to the maximum. The system is characterized in that an insoluble content is regulated in correspondence to the maximum rotation speed of a relative motion so as to be within a range of a specific optimum percentage content with respect to a lubricating oil so as to be contained, and is maintained, in a friction system in which the lubricating oil is interposed between two objects for the purpose of suppressing a wear due to a friction of a friction surface in a contact periodical relative motion between the two objects.

10 Claims, 11 Drawing Sheets

FOREIGN PATENT DOCUMENTS

| | | |
|---|---|---|
| JP | A-9-100712 | 4/1997 |
| JP | 9-292096 | 11/1997 |
| JP | 09-292096 | 11/1997 |
| JP | A-10-082735 | 3/1998 |
| JP | 10-192613 | 7/1998 |
| JP | 10-306715 | 11/1998 |
| JP | A-2003-185090 | 3/2003 |
| WO | WO 2005/033575 | 4/2005 |

* cited by examiner

Percentage content of insoluble content in lubricating oil and wear state of bore friction surface

SUPPRESSING METHOD OF WEAR IN FRICTION SYSTEM BETWEEN TWO OBJECTS

TECHNICAL FIELD

The present invention relates to a technique of suppressing a wear due to a friction by interposing a lubricating oil in a friction surface of a friction system between two objects, and more particularly to a technique of improving a reliability of an internal combustion engine by suppressing a wear due to a friction between a cylinder and a piston in the internal combustion engine.

BACKGROUND ART

It is considered that a factor of the wear in the friction system between two objects is a friction between the objects. Accordingly, it has been conventionally considered that the wear is absorbed by interposing the lubricating oil between the objects, for example, between the cylinder and the piston in the internal combustion engine, whereby the wear is suppressed. In fact, it is apparent from experience that the wear is reduced by interposing the lubricating oil. However, the wear can not be completely prevented by interposing the lubricating oil in the friction surface, but can be only suppressed. The question lied in the fact that how effectively the wear can be suppressed with respect to the used time, whereby it is possible to improve the reliability of the internal combustion engine.

As is well known, it is recommended by professional manufacturer companies to replace an entire amount of the lubricating oil or the like in the internal combustion engine every specific period use or specific time use or drain a part of the lubricating oil and resupply a fresh oil. This is because the system oil of this sort generates an oxidative polycondensation effect in use, a combustion product is mixed thereto, and a metal wear particle, a rust or the like is contained therein, the system oil of this sort generates various insoluble contents. Among them, a solid body generated in the lubricating oil is increased with age at a time of being used and causes to damage the friction surface.

For these reasons, the professional manufacturer companies define respective nature limit values for the unique lubricating oils (refer to Table 1). The nature limit values are defined until now, for example, such that n-pentane insoluble content corresponding to a hydrocarbon of methane series contained in the lubricating oil is 1.5 mass % in a two-cycle engine and 2.5 mass % in a four-cycle trunk piston engine on the basis of an analysis in accordance with a method A. However, in fact, it is considered the nature limit value defining an allowable limit of using the lubricating oil varies in accordance with the size of a dust particle contained in the lubricating oil, a surface finish roughness in the friction surface, a kind of the generated material generated in the lubricating oil, the size of the particle, or a content thereof, it is hard to define the nature limit value, a clear base supporting the allowable limit has not been known, and the content of insoluble content is experientially set to be equal to or less than about 2.5 mass %. In other words, the lubricating oil is normally required to be replaced when the content of the insoluble content contained in the lubricating oil becomes more than 2.5 mass % as matters stands, and it is believed that the lubricating oil can be used without replacing the oil as far as the content is equal to or less than 2.5 mass %.

Table 1

However, the inventors have found that the conventional systems mentioned above do not suppress a deterioration of the internal combustion engine due to the wear on the friction surface between the cylinder and the piston to the minimum, rather they damage the surfaces of the cylinder and the piston corresponding to guts of the engine by using the lubricating oil at an impurity percentage content set as the allowable limit exceeding by far the optimum value of the nature of the lubricating oil, so that a performance of the engine is lowered, and a service life is significantly shortened.

In order to always keep the engine in an optimum state at a time of being used, it is necessary to take various factors into consideration. In particular, in order to keep the friction surface between the cylinder and the piston, between a bore and a shaft, or the like in an optimum state, the kind of the insoluble content such as the pentane or the benzene contained in the lubricating oil to be interposed in the friction surface as mentioned above and a corrosion content, the size of the particle, the content thereof, a fuel supply amount, an engine speed, a diameter and a size of the cylinder, a surface roughness of the friction surface, and the like are concerned. As a result of devoting themselves day and night to research over a long period, the inventors have found that the various factors affecting the nature of the engine can be represented by the percentage content of the insoluble content with respect to the lubricating oil interposed in the contact surface, and in the case that the percentage content of the insoluble content adopts a value within the specific value range corresponding to the engine speed or the maximum rotation speed, the wear on the friction surface is suppressed to the minimum, and reaches a completion of the present invention.

DISCLOSURE OF THE INVENTION

In other words, an object of the present invention is to provide a method of suppressing a wear in a friction system between two objects which can significantly reduce a trouble in a lubricant system by indicating an optimum lubricating oil nature value and applying a lubricating oil regulated to the nature value to an internal combustion engine having various sizes and rotation sizes so that the lubricating oil for the engine keeps the nature value to an optimum level, and can suppress a wear of a friction surface in a slidable portion between a cylinder and a piston or between a bore and a shaft so that it is possible to make an overhaul period longer and extend a service life of the engine to the maximum.

A means which the present invention employs for solving the problem mentioned above is characterized in that an insoluble content is regulated so as to be within a range of a specific percentage content with respect to a lubricating oil so as to be contained, and is maintained, in a friction system in which the lubricating oil is interposed between two objects for the purpose of suppressing a wear due to an abrasion of a surface in a contact periodical relative motion between the two objects.

A corresponding value between the maximum rotation speed and the percentage content is structured such that in the case that a continuous monotone decreasing curve passing through a point (25 rpm, 0.8 mass %), a point (100 rpm, 0.5 mass %), a point (750 rpm, 0.2 mass %), a point (1200 rpm, 0.1 mass %), a point (3000 rpm, 0.05 mass %), and a point (8000 rpm, 0.025 mass %) can use a percentage content p of the insoluble content and can be expressed as a function of the maximum rotation speed n, that is, p(n) in which the points on a graph are expressed by (n, p), the graph adopting the maximum rotation speed n as a horizontal axis and the percentage content as a vertical axis, a percentage content P of the insoluble content with respect to the lubricating oil including an effective error range is given by a formula $P(n)=p(n)\pm0.05$ mass %, is regulated and maintained such as to contain the insoluble content with respect to the lubricating oil within the value range, and suppresses the wear due to the friction between the two objects.

Further, the insoluble content is constituted by an n-pentane.

Further, the friction system between two objects is constituted by a friction system comprising a cylinder and a piston, or a bore and a shaft axially supported to the bore.

Further, the means for regulating and maintaining the percentage content of the insoluble content with respect to the lubricating oil regulates and maintains the lubricating oil by using a precise filtering means. In this case, the precise filtering means in the present invention corresponds to a filtering means which has a filter element capable of precisely filtering the insoluble content of a combustion product, an incomplete combustion product or the like, and can regulate the percentage content of the insoluble content with respect to the lubricating oil within a target range, and is particularly structured such as to include a filter element formed by laminating a lot of thin sheets, and passes the lubricating oil through a paper laminated gap so as to makes an impurity constituted by the combustion product, the incomplete combustion product or the like contained in the lubricating oil to be attached to a paper fiber on the basis of a molecular Brownian motion and be removed. It is preferable that the precise filtering means can effectively remove the impurity having a size equal to or more than 1 μm, however, is not limited as far as the precise filtering means can achieve the object mentioned above.

Further, the means for regulating and maintaining the percentage content of the insoluble content with respect to the lubricating oil replaces a part of an entire of the lubricating oil at the right time when the percentage content of the insoluble content deviates from the range given by the function P(n) of the maximum rotation speed n, thereby setting the percentage content of the insoluble content in the range given by the function P(n) so as to regulate and maintain the lubricating oil.

In the friction surface to which the present invention is applied, and which is structured such as to always regulate and keep the percentage content of the insoluble content to a predetermined value in correspondence to the maximum rotation speed of the slide of the friction system, it is possible to suppress the wear of the friction surface to the minimum limit. As a result, it is possible to continuously keep the friction surface in an optimum state over a long period.

In the case that the present invention is applied to the method of suppressing the wear of the friction surface in the internal combustion engine, it is possible to define the nature of the lubricating oil system of the internal combustion engine generated by a complicated effect of the various factors, on the basis of a simple relation between the rotation speed and the percentage content of the insoluble content with respect to the lubricating oil corresponding to the rotation speed, in common to all the internal combustion engines, it is possible to concisely indicate the optimum value for the internal combustion engine for keeping the internal combustion engine in the optimum state, and it is possible to regulate such that the state is always kept.

Further, it is possible to significantly reduce a trouble in the lubricating oil system such as a trouble that almost no combustion residual material is present in an exhaust valve or a turbine nozzle, or the like, and it is possible to make an overhaul period longer by significantly reducing the wear of the slidable portion such as the cylinder, the piston, the bore, the shaft or the like. As a result, it is possible to widely elongate a service life of the engine, and it is possible to reduce damage resulting from failures and during service and maintenance.

BEST MODE FOR CARRYING OUT THE INVENTION

Figure 1:
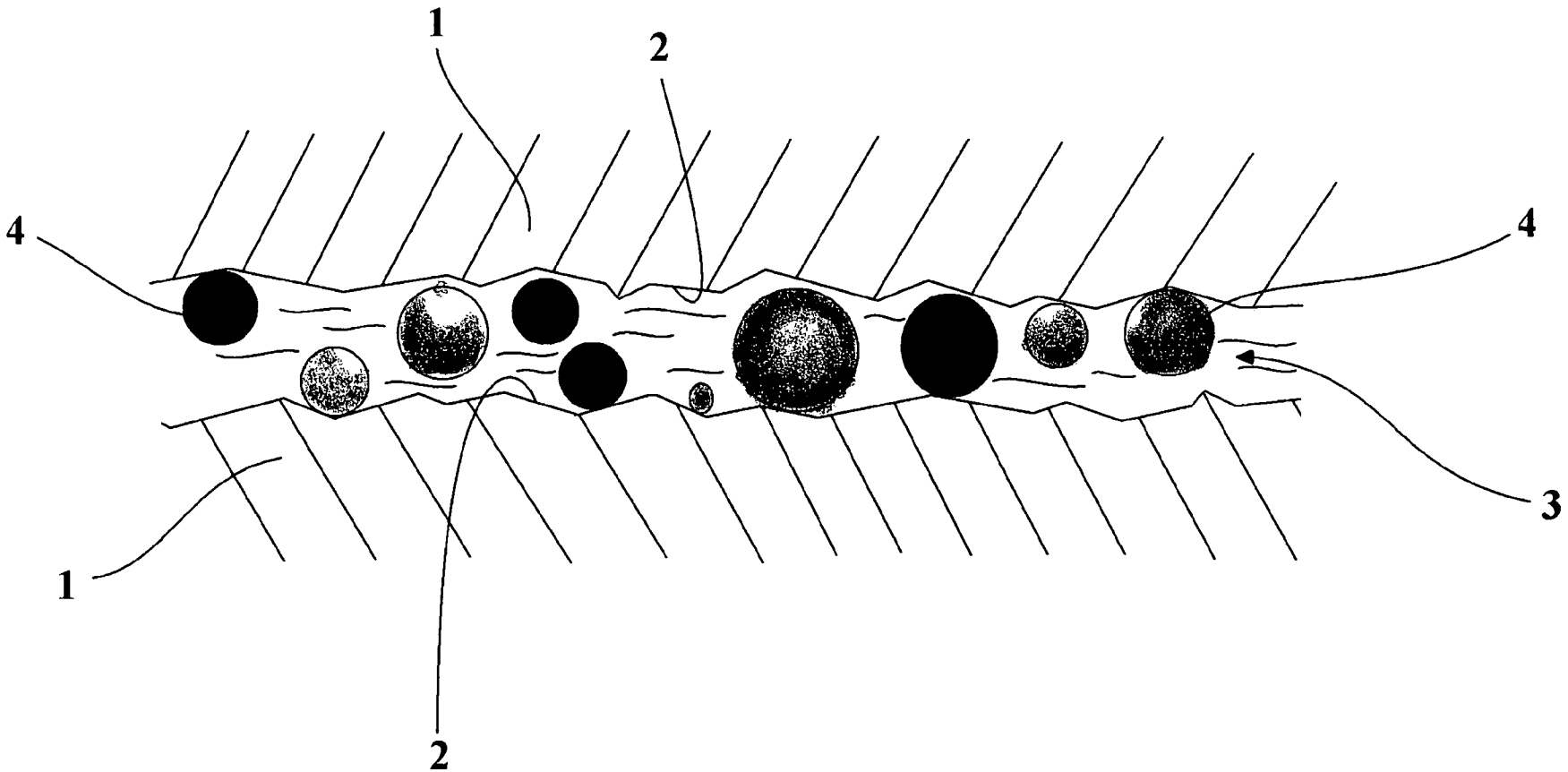
FIG. 1 is a view showing a state of a contact surface in accordance with the present invention.
Figure 2:
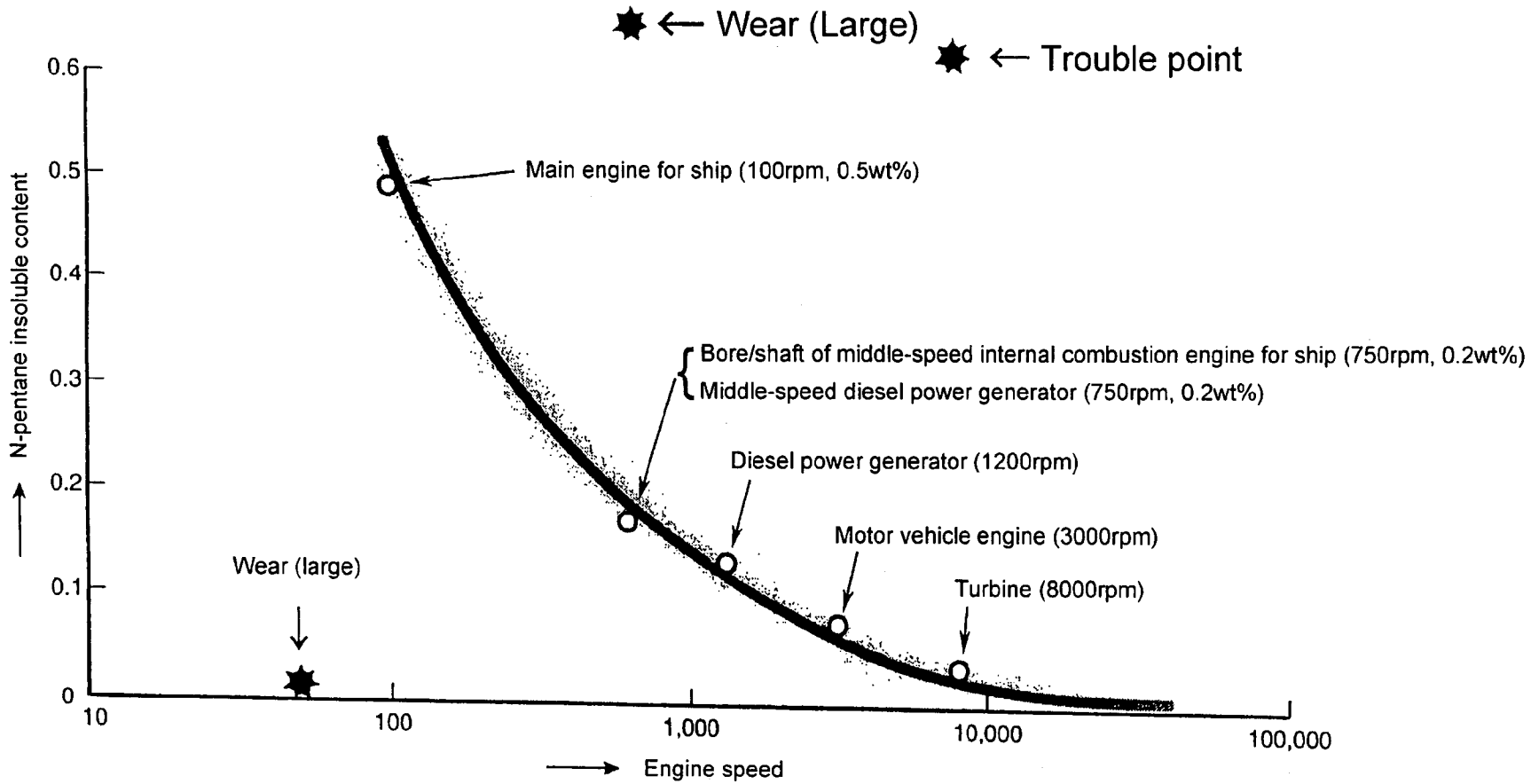
FIG. 2 is a graph showing a relation between a percentage content of an insoluble content and a rotation speed which can suppress a wear of a friction surface to the minimum.

A description will be in detail given below of a preferable embodiment in accordance with the invention with reference to the accompanying drawings. FIG. 1 is a view showing a state of a contact surface in accordance with the present invention, and FIG. 2 is a graph showing a relation between a percentage content of an insoluble content and a rotation speed of a friction surface corresponding thereto which can suppress a wear of the friction surface to the minimum in accordance with the present invention plotted on a percentage content of an insoluble content/rotation plane. A method of suppressing the wear in a friction system between two objects in accordance with the present embodiment is provided with two objects performing a relative motion in a contact and periodical manner, a lubricating oil 3 interposed in a contact surface or a friction surface 2 between the two objects, and an insoluble content 4 contained in the lubricating oil 3, and is structured such as to use a percentage content control means for regulating and keeping the percentage content of the insoluble content 4 with respect to the lubricating oil 3 so as to have a specific value.

The two objects mentioned above in the present embodiment are respectively constituted by a cylinder and a piston of an internal combustion engine which execute a simple harmonic oscillation in a contact and relative manner, however, two objects are not particularly limited as far as they form the friction surface 2 between two objects on the basis of the relative motion in the contact and periodical manner. For example, they may be constituted by a bore 7 and a contact surface between the bore 7 and a shaft 5 axially supported thereto, as in the embodiment mentioned below.

The lubricating oil 3 can employ a conventionally known oil, for example, can employ an engine oil, a working fluid, a turbine oil, a gear oil or the like, however, it goes without saying that the lubricating oil 3 is not particularly limited as far as the lubricating oil 3 has an effect of suppressing a wear of the friction surface 2.

Since the lubricating oil 3 generates an oxidative polycondensation effect in use, a combustion product is mixed thereto, and a metal wear particle, a rust or the like is contained therein, the insoluble content 4 mentioned above indicates a general insoluble content 4 generated in the lubricating oil 3 as an extensive meaning, particularly indicates various kinds of solid bodies having various particle sizes which are generated in the lubricating oil 3 and cause to damage the friction surface 2, and more particularly indicates various kinds of insoluble contents 4 including a hydrocarbon compound such as a benzene insoluble content 4, a pentane insoluble content 4 corresponding to a hydrocarbon compound of methane series or more general n pentane insoluble content 4. However, the present invention pays attention to a matter that the insoluble content 4 in an extensive meaning can be represented by the n pentane insoluble content 4. Accordingly, it may be specified to the n pentane insoluble content 4 in a narrow meaning, or it goes without saying that it may be constituted by the insoluble content 4 in the extensive meaning without being limited to the insoluble content 4 in the narrow meaning.

A percentage content of the insoluble content 4 with respect to the lubricating oil 3 mentioned above corresponds to an optimum value for suppressing the wear of the friction surface 2 to the minimum, and the inventors have devoted themselves to research and have found that the optimum value of the percentage content mentioned above is not absolutely monovalent, and as shown in FIG. 2, depends on a rotation speed of a periodical motion of the friction system, and the optimum value of the percentage content exists in correspondence to the rotation speed. The percentage content mentioned above has a monovalent property in a meaning of the optimum value of the percentage content corresponding to the rotation speed. Further, FIG. 2 shows in a band-like optimum value line obtained by rotating various engines at various rotation speeds, determining the optimum value of the percentage content of the insoluble content with respect to the rotation speed at which the wear state is most suppressed, and plotting them on a percentage content of an insoluble content/rotation speed plane, and shows the optimum value of the percentage content of the insoluble content which can plot the internal combustion engine having the representative maximum rotation speed on the graph, increase a nature of the internal combustion engine to the maximum, and improve a reliability.

As is apparent from FIG. 2, in the internal combustion engine having the maximum rotation speed, the optimum value of the percentage content of the insoluble content corresponding to the maximum rotation speed is smaller than the value of the percentage content of the insoluble content corresponding to the rotation speed less than the maximum rotation speed, and if the percentage content of the insoluble content is constituted by a finite small value, the wear of the friction surface 2 becomes smaller at that degree. As a result, it is known that in the internal combustion engine having the maximum rotation speed, if the percentage content of the insoluble content is kept at about a level equal to or less than the percentage content of the insoluble content corresponding to the maximum rotation speed, it is possible to keep a preferable nature of the combustion engine in use over a long period even by actuating the internal combustion engine at any rotation speed. Accordingly, on the assumption that a rotation speed in a horizontal axis is the maximum rotation speed, in the case that the internal combustion engine having a predetermined maximum rotation speed is given, it is possible to increase a reliability to the maximum and it is possible to know the optimum value of the percentage content of the insoluble content necessary for keeping the preferable nature. Therefore, it is possible to always keep the internal combustion engine in the preferable nature by regulating and keeping the nature of the lubricating oil 3 in the optimum value mentioned above by using the means for regulating and keeping the nature of the lubricating oil 3, and it is possible to have longer durability, and it is possible to intend to make a service life of the internal combustion engine itself long.

Further, although an illustration is omitted, it is considered that the wear in the friction surface 2 is small in the case that the insoluble content 4 is contained at a small percentage content in comparison with the case that the percentage content of the insoluble content is zero. Accordingly, the optimum range of the percentage content of the insoluble content with respect to the lubricating oil 3 means a range from the finite minimum value larger than zero to the maximum value obtained by the value given by the function P(n) having a certain rotation speed n. It is possible to keep the internal combustion engine in the optimum nature by fitting the percentage content of the insoluble content into the optimum value range. The optimum value range of the percentage content of the insoluble content is shown as a gray zone in both sides of a solid line in FIG. 2. For example, in a middle-speed diesel engine at 750 rotation, since the percentage content 0.8% already exists out of the gray zone range and generates a trouble, it becomes in a range between 0.2 and 0.01%. In a diesel engine at 1200 rotation, the percentage content of the insoluble content becomes between 0.01 and 0.15%. Further, in an engine of a motor vehicle at 3000 rotation, it becomes equal to or less than 0.1%, and in a turbo charger engine at 8000 rotation, it becomes equal to or less than 0.05%.

The percentage content control means mentioned above can be structured by attaching a precise filtering means to the internal combustion engine, it is possible to appropriately remove the insoluble content 4 of unnecessary quantity and size by employing the precise filtering means having a filter area in correspondence to the maximum rotation speed of the internal combustion engine, and it is possible to keep a desired percentage content of the insoluble content over a long period. Further, in the case that the filter is soiled in accordance with the long time use, it is possible to replace only a filter portion of the precise filtering means, and it is possible to permanently use the lubricating oil 3 while keeping the lubricating oil 3 in the optimum nature. Of course, the filter serving as the percentage content control means is not limited to the precise filtering means as mentioned above as far as it plays a part as mentioned above. Otherwise, the percentage content control means may be structured such that the percentage content of the insoluble content 4 contained in the lubricating oil 3 is regulated in the range of the optimum value mentioned above by replacing a part or an entire of the lubricating oil 3 by a fresh oil in place of the filtering by the filter or the like as mentioned above, or may be structured by combining the filtering method and the oil replacing method.

Figure 3A:
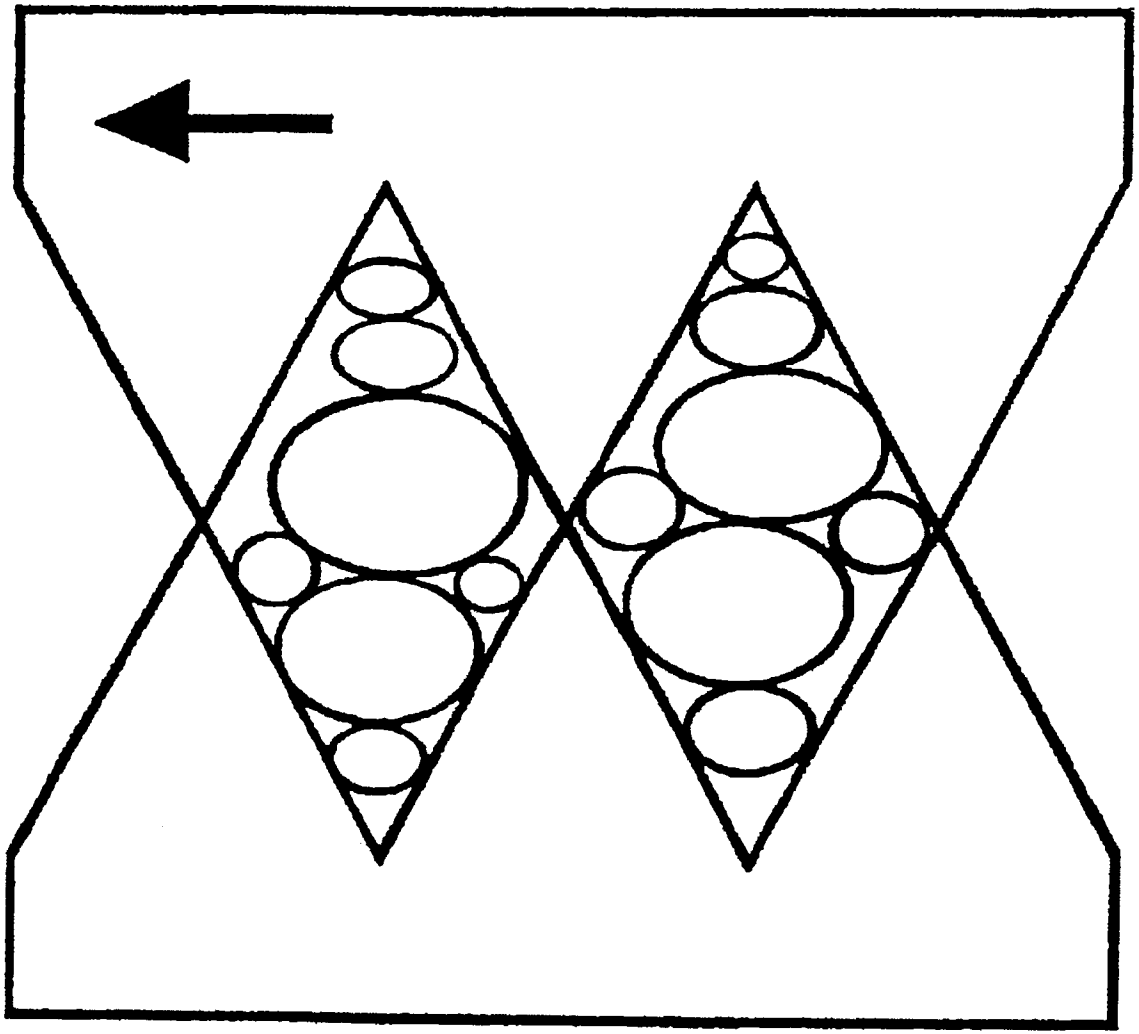
FIG. 3A is a schematic view showing a proper dirty state in a friction portion of a low-speed engine.
Figure 3B:
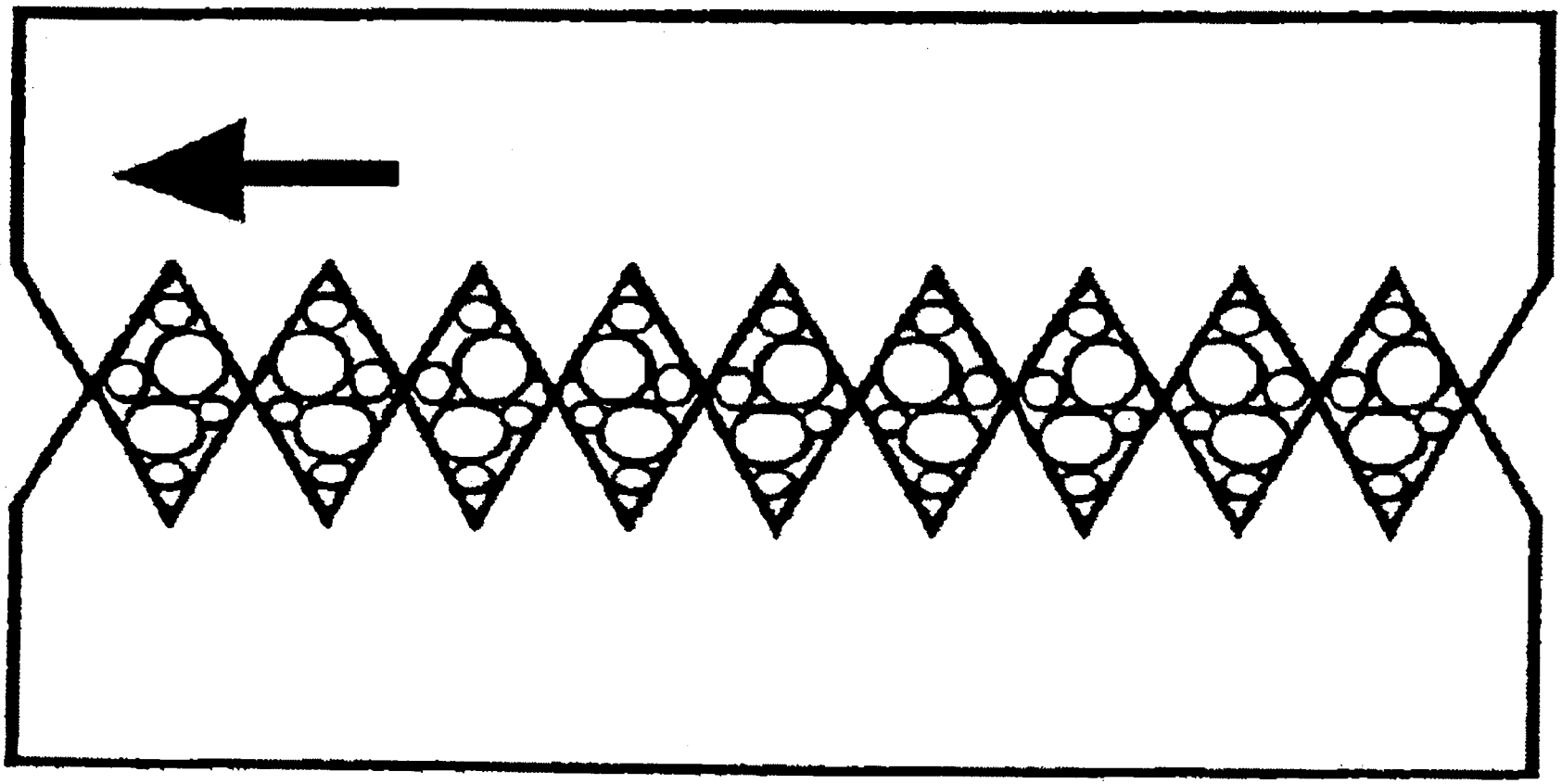
FIG. 3B is a schematic view showing a proper dirty state in a friction portion of a high-speed engine.

Further, the inventors have considered that the soil of the lubricating oil making the wear minimum is not fixed, but is dependent on the rotation speed of the engine, and have found that a size of a sludge particle in the proper lubricating oil is comparatively large in the low-speed engine, and it is necessary to keep the lubricating oil clean and make the size of the sludge particle in the lubricating oil small, in accordance with a speed increase. FIG. 3 schematically shows slide surfaces of the low-speed engine and the high-speed engine, and a state of the proper soil of the lubricating oil. As shown in this drawing, if the depressed sludge particle has a size and a quantity matching to a size of depression, the sludge particle reduces the wear on the basis of an effect of a ball bearing. For example, this shows a matter that since the depression is large in the low-speed engine, the large sludge particle exists in the lubricating oil as the proper soil, as shown in FIG. 3A, and it is preferable that the sludge particle in the lubricating oil is comparatively small in the high-speed small-size engine as shown in FIG. 3B.

Embodiment 1

Figure 4:
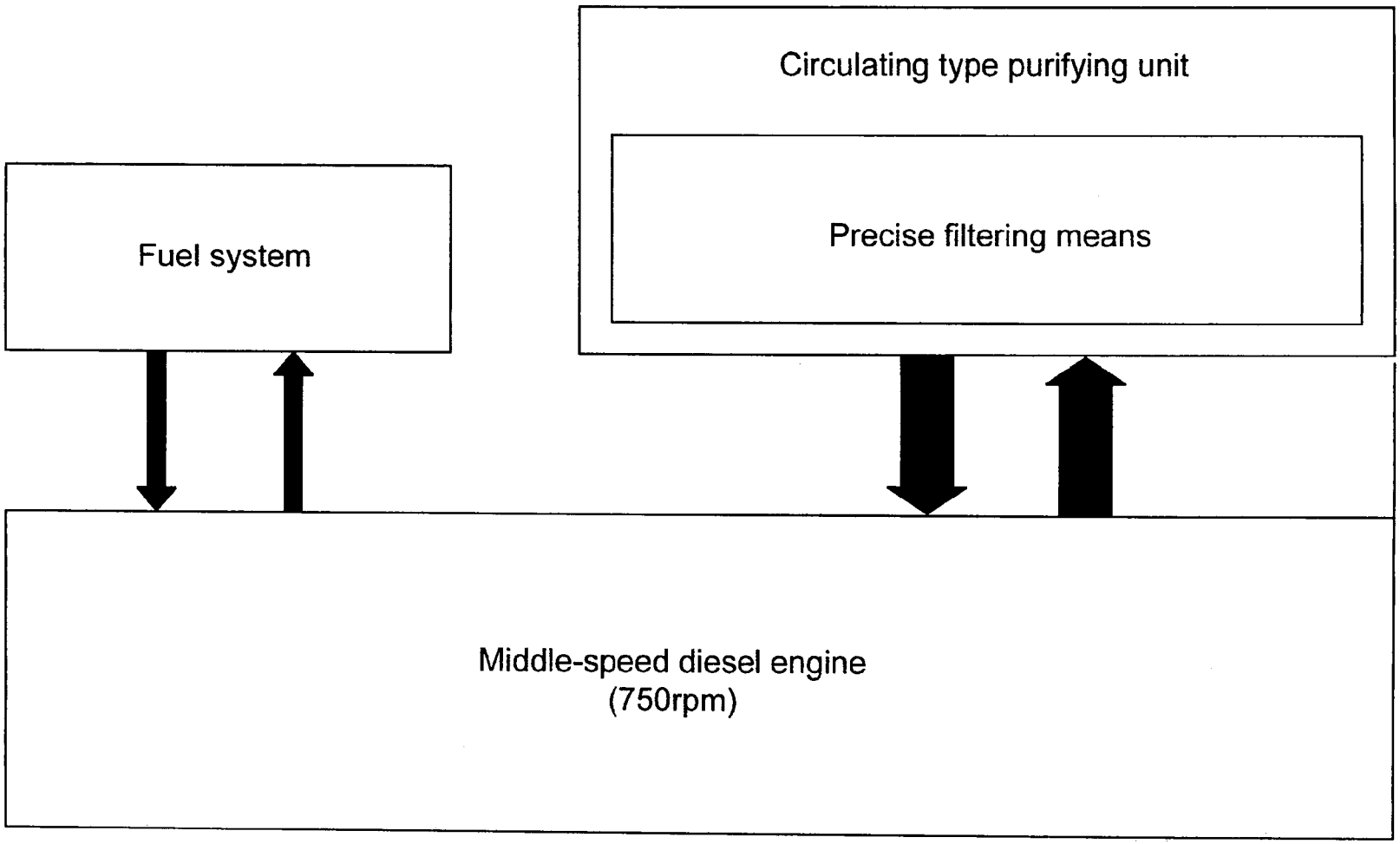
FIG. 4 is a schematic view of a diesel engine in which a precise filtering means is installed.

Next, a description will be given of one example to which the present invention is applied, and results of actual measurement thereof with reference to FIGS. 4 to 6, thereby viewing an effectiveness of the present invention. As shown in FIG. 4, the structure of the present embodiment is made such that a diesel engine at 750 rpm to the maximum, and a precise filtering means communicated therewith and filtering the lubricating oil 3 while circulating are provided, and the lubricating oil 3 is interposed in the friction surface 2 between the cylinder and the piston within the diesel engine, thereby suppressing the wear of the friction surface 3.

Figure 5:
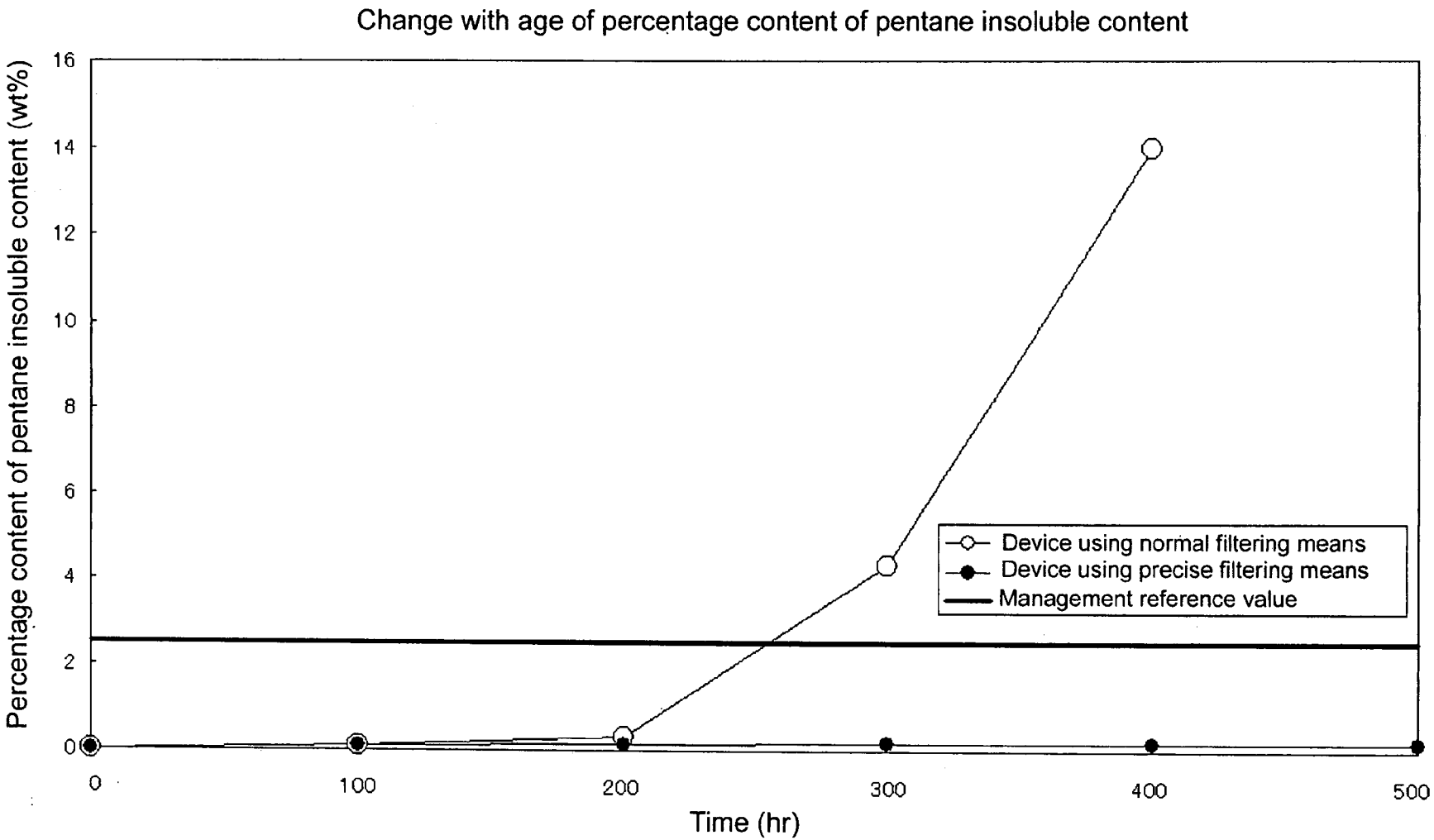
FIG. 5 is a graph showing changes with age of a percentage content of a pentane insoluble content in a conventional machine and a machine having a precise filtering means.
Figure 6:
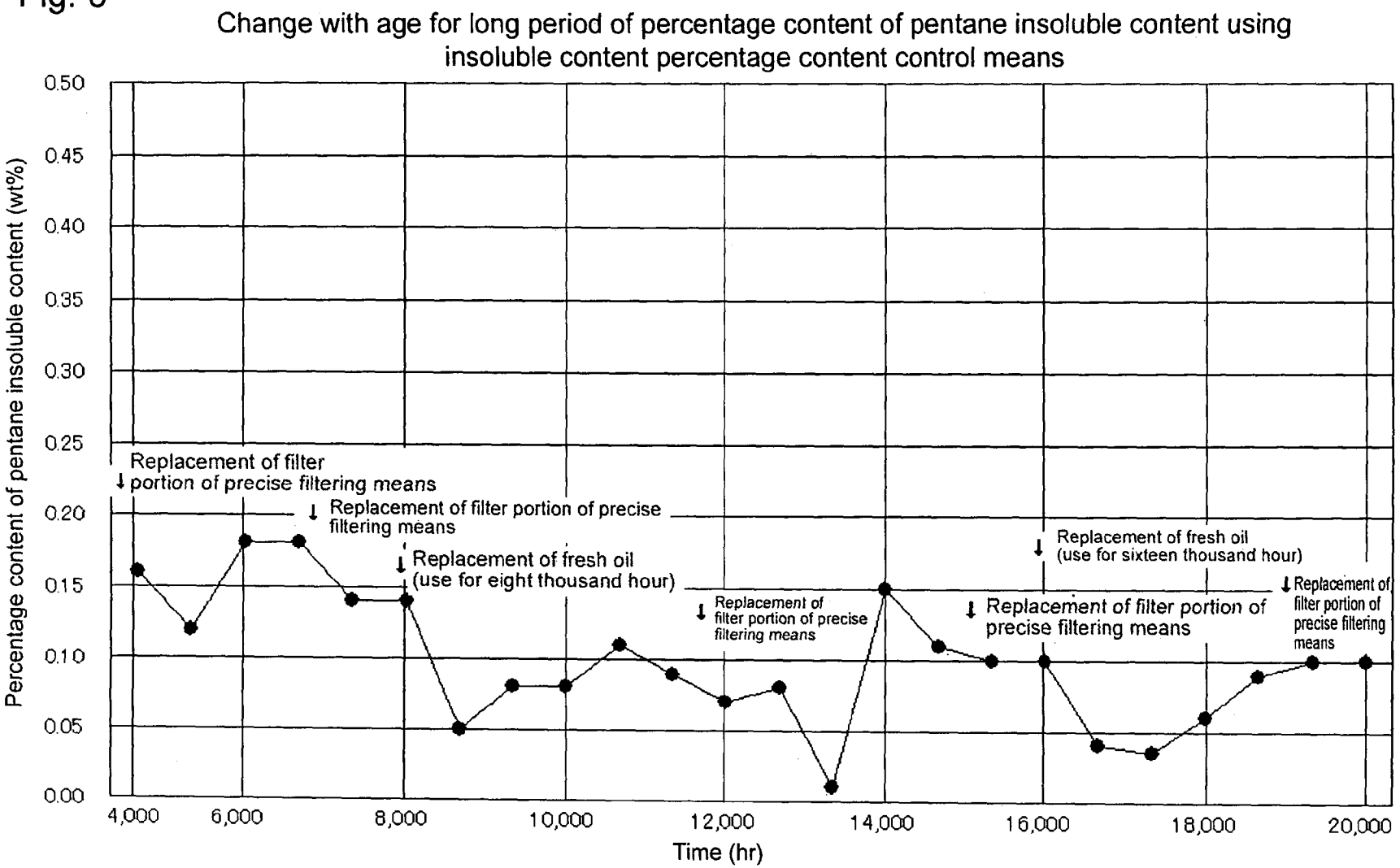
FIG. 6 is a graph showing changes with age for a long period of the percentage content of the pentane insoluble content in the machine having the precise filtering means.

For example, as is apparent from a graph showing a state of a change with age of the percentage content of the pentane insoluble content in the diesel engine which is not provided with the precise filtering means, and the diesel engine in which the precise filtering means is placed, in a state of 750 rpm in FIG. 5, the percentage content of the pentane insoluble content is rapidly increased from 200 hour in the diesel engine which is not provided with the precise filtering means, and is over a standard value defined by various manufacturer companies at a time point when 200 and some tens hours have passed, and the rapid increase thereafter continues. On the contrary, in the case of the diesel engine in which the precise filtering means is placed, the state less than 0.2 mass % is continuously kept even after 500 hours have passed. In accordance with thereafter state, as is apparent from FIG. 6 showing a state of the change with age for a long period of the percentage content of the pentane insoluble content in the diesel engine in which the precise filtering means is placed, there is obtained a result that it is possible to continuously suppress the percentage content of the insoluble content in the lubricating oil 3 to 0.2 mass % or less during about 20000 hour, by replacing the filter portion at a pace of about one every 5000 hour, and replacing the oil by the fresh oil at a pace of about one every 8000 hour.

Embodiment 2

Figure 7:
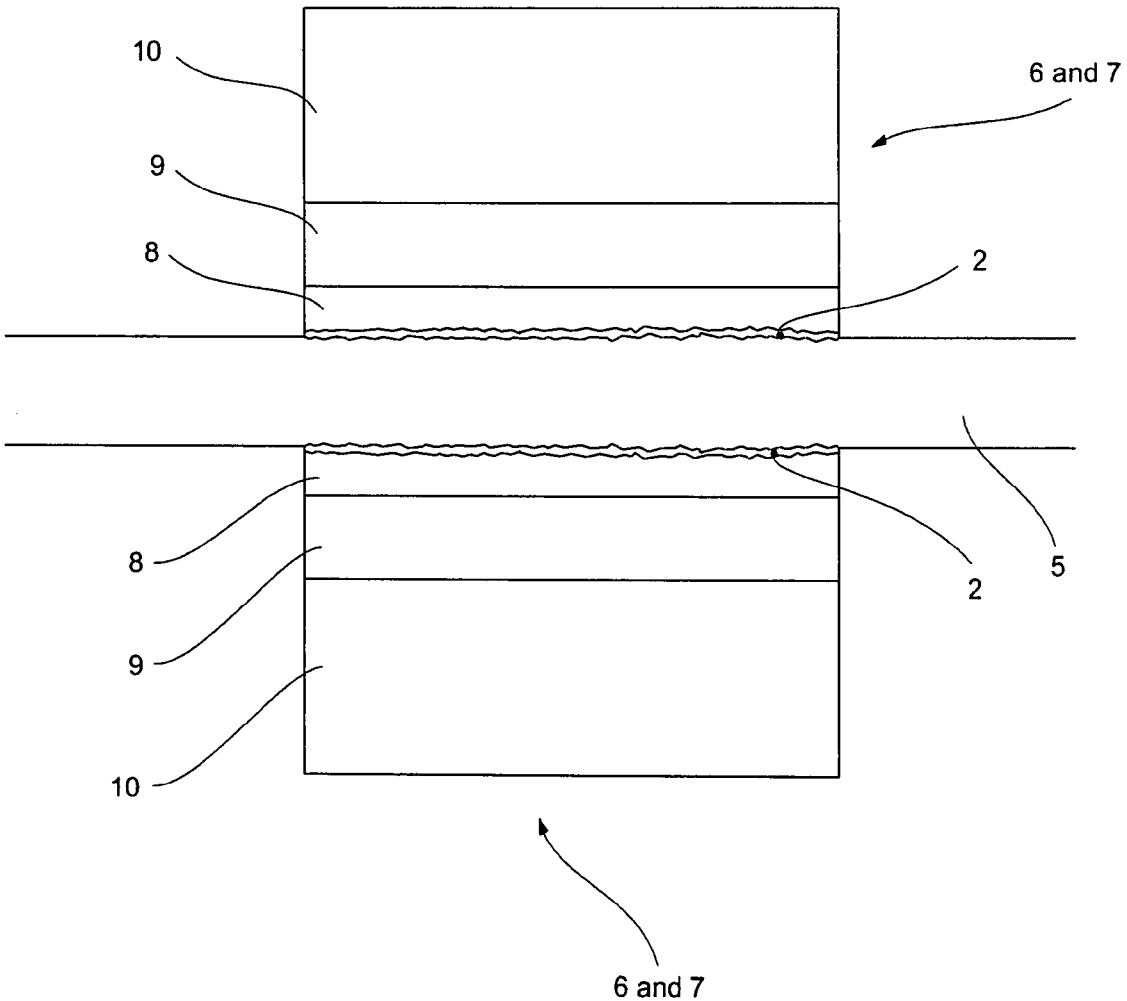
FIG. 7 is a cross sectional view showing a laminated structure of a middle-speed bore for a ship.

Next, a description will be given of one example to which the present invention is applied, and results of actual measurement thereof with reference to FIGS. 7 to 9, thereby viewing an effectiveness of the present invention. The structure of the present embodiment is made such that a middle-speed diesel engine for a ship at 750 rpm to the maximum is provided with a shaft 5 for transmitting a power of the engine and applying a rotation force to a screw, and a bore 7 formed in a cylindrical shape by bonding two semicircular arc metal parts 6 for bearing and axially supporting the shaft 5, and is provided with the lubricating oil 3 interposed in the friction surface 2 between the bore 7 and the shaft 5, and the insoluble content 4 contained in the lubricating oil 3, and the bore 7 in accordance with the present embodiment has a three-layer laminated structure constituted by an overlay layer 8, a nickel dam layer 9 and a lead bronze layer 10 as shown in FIG. 6.

Figure 8:
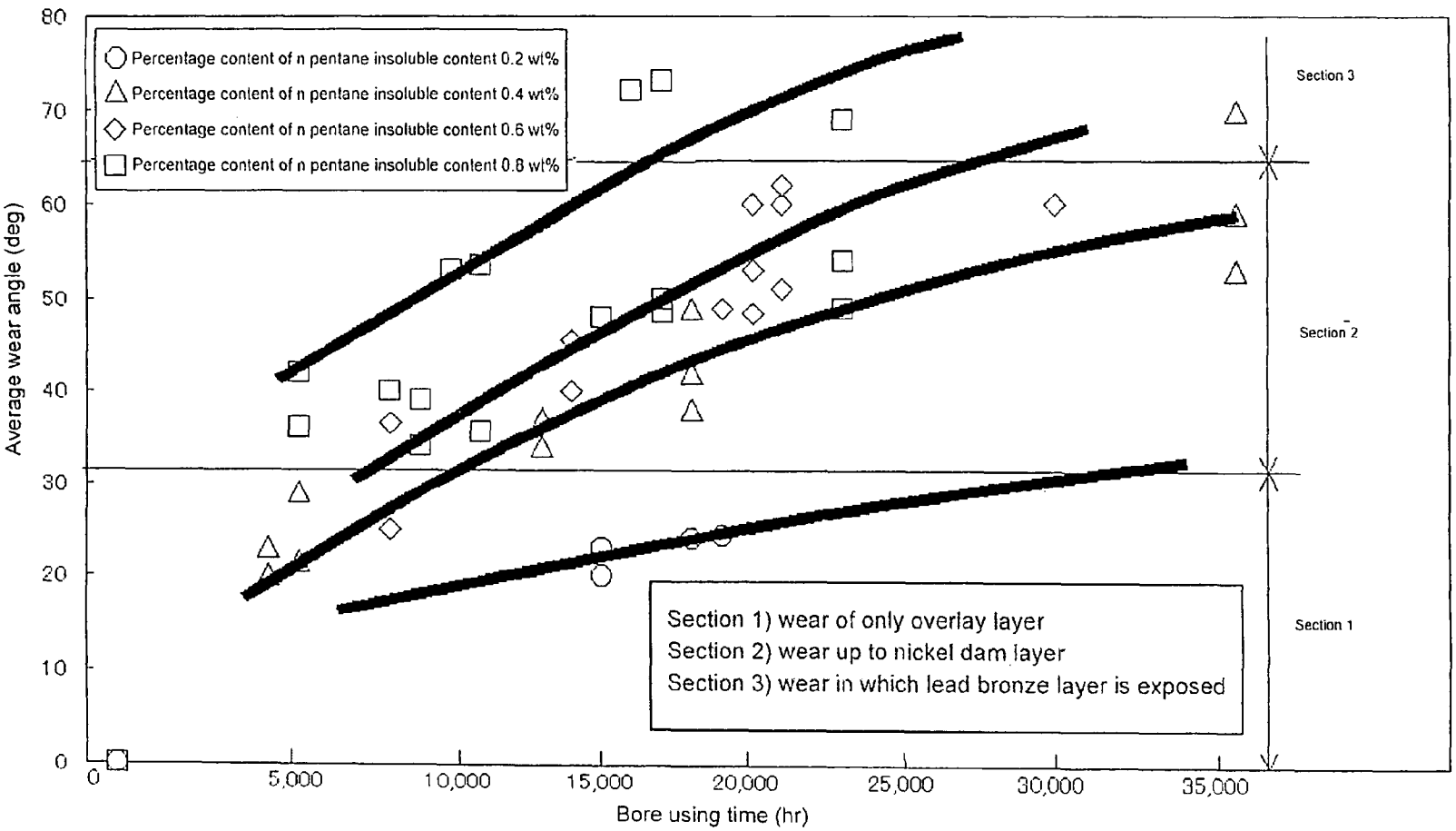
FIG. 8 is a graph showing a relation between the percentage content of the pentane insoluble content and a wear degree in the middle-speed bore for the ship.
Figure 9:
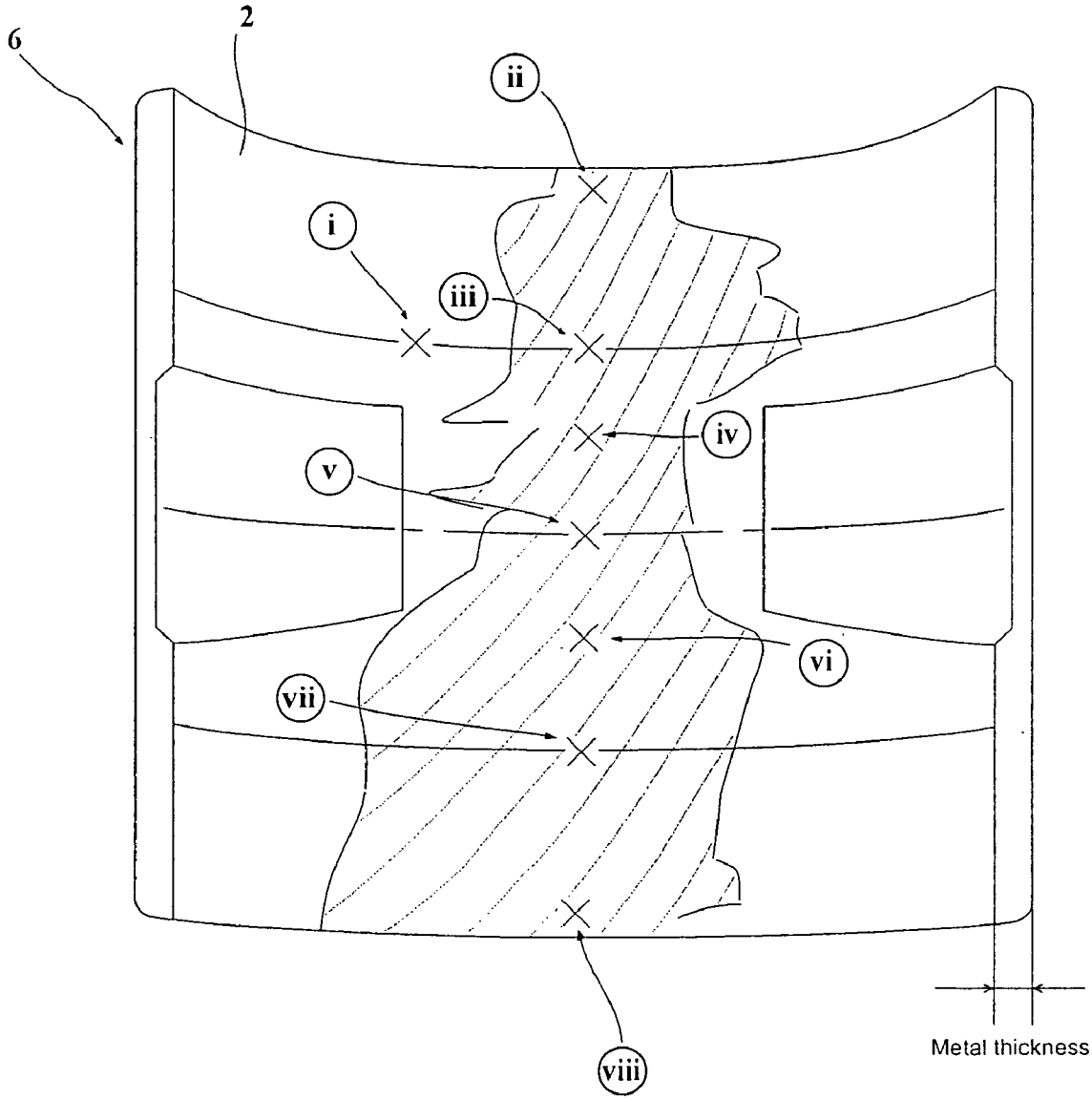
FIG. 9 is a view showing a state of a wear of a friction surface metal in the bore in accordance with the present embodiment.

FIG. 8 shows the results obtained by rubbing the friction surface 2 between the bore 7 and the shaft 5 by rotating for a long period while keeping various percentage content of the insoluble content, and searching a wear degree of the friction surface in each of the percentage contents, with using the diesel engine in accordance with the present invention. As shown in FIG. 8, in the case of actuating while keeping the percentage content of the pentane insoluble content 4 in the lubricating oil 3 with respect to the lubricating oil 3 in accordance with a method A in 0.2 mass %, the degree of wear is about 20 degree at an average wear angle, this indicates the wear of only the overlay layer 8 of the front layer of the bore 7, and indicates that the average wear angle becomes comparatively large and the degree of the wear makes progress in accordance that the percentage content becomes higher in the case that the percentage content is more than 0.4 mass %, thereby generating the wear at about a degree of exposing not only the overlay layer 8 but also the nickel dam layer 9 in a lower layer of the overlay layer 8 and the lead bronze layer 10 in further a lower layer of the nickel dam layer 9.

As is apparent from this matter, an important factor determining the degree of wear can be represented by the n pentane insoluble content 4, and the degree of the wear is different in accordance with the percentage content of the n pentane insoluble content 4. Further, taking the results in FIG. 1 and the like into consideration, it is known that the optimum value of the percentage content exists in correspondence to the rotation speed, and it is possible to suppress the wear of the friction surface 2 to the minimum by keeping the percentage content in the optimum value, that is, the value about the level equal to or less than 0.2 mass % in the present embodiment.

Figure 10:
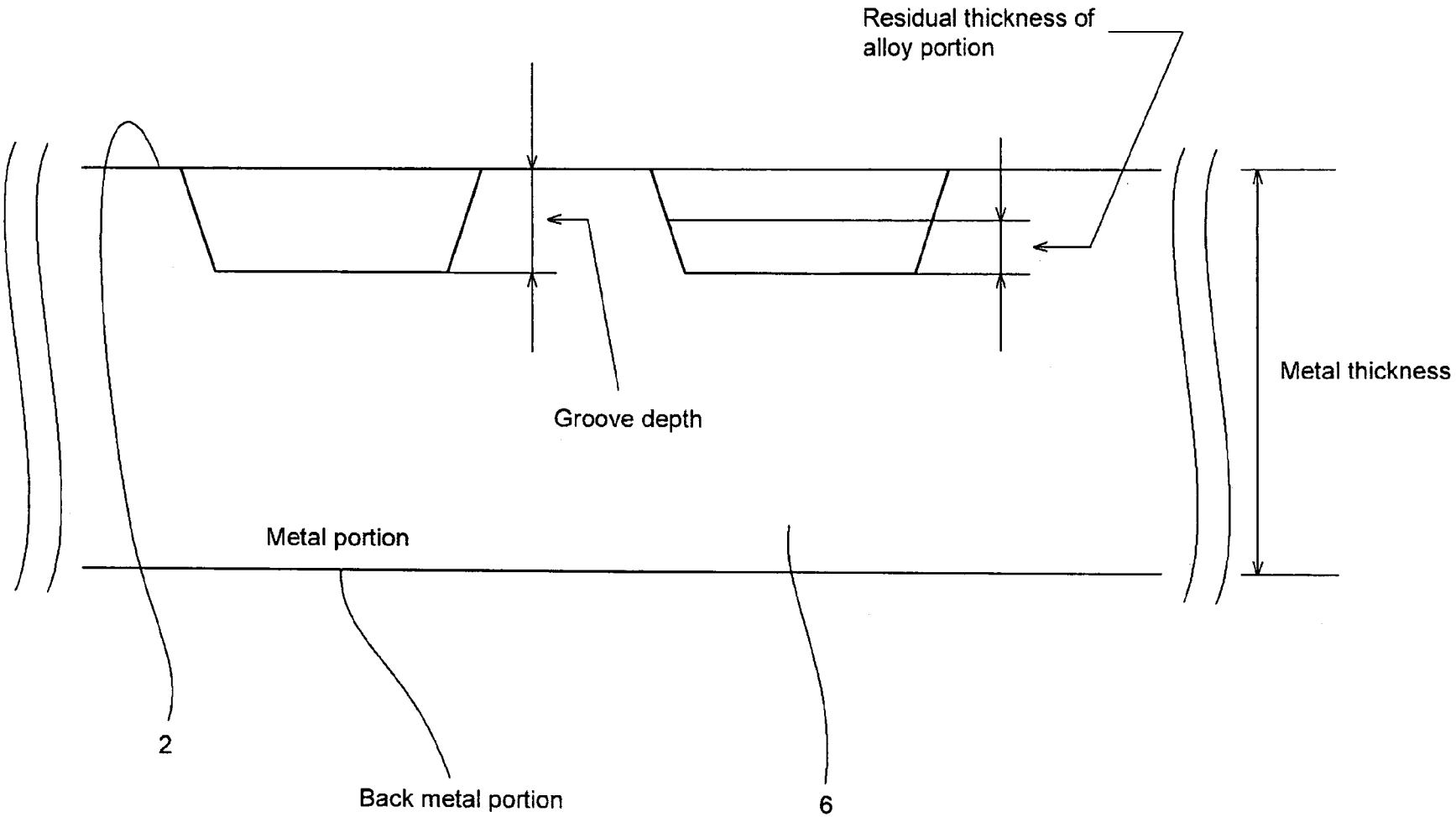
FIG. 10 is a cross sectional view around the wear portion of the bore in accordance with present embodiment.

A wear quantity of the friction surface 2 of the bore 7 is measured at a time point when the bearing use time has passed twenty thousand hours in the percentage content of 0.2 mass %. As a result, FIG. 9 shows a state of a metal wear of a portion where the wear makes progress most and around the portion, and Table 2 shows results of metal wear quantity measurement of the measured positions (i) to (viii) shown in FIG. 9. FIG. 10 is a cross sectional view showing a concept of items shown in Table 2 correlating with states of the measured positions.

As is apparent from Table 2, there can be obtained a result that it is possible to keep a state in which the metal wear is hardly generated, that is, it is possible to highly suppress the wear of the friction surface 2 between two objects, in the friction surface 2 in which the percentage content of the insoluble content is continuously inhibited to be less than 0.2 mass %, even when the bore 7 and the shaft 5 are rubbed over a long period near twenty thousands hours. In this case, an entire thickness in Table 2 indicates the results of measurement by a micrometer and a measure scope, a metal wear quantity indicates a value calculated by a calculating formula "reference value−groove depth" on the basis of the measured value 0.040 mm of sound portion (i). In this case, it is necessary to pay attention to a matter the wear does not make progress up to the nickel dam layer 9, in any of the results of measurement (i) to (viii) shown in Table 2. In other words, as has been already mentioned, in the case of keeping the percentage content of the insoluble content in 0.2 mass % and using the bore 7 in the bearing over twenty thousands hours, there is shown that the wear makes progress only to the overlay layer 8 corresponding to the front layer of the bore 7, and t is possible to significantly suppress the wear in comparison with the conventional one.

Table 2

Table 2 shows the results obtained by searching the state of the wear in the friction surface 2 between the bore 7 and the shaft 5, and the results show that the same result can be obtained in the friction system between two objects such as between the cylinder and the piston in the embodiment 1 mentioned above, and corresponds to one of results for supporting a matter that a relation such as a graph shown in FIG. 2 is established between a rotation speed of a friction sliding in the friction system between two objects, and a proper value of the percentage content of the insoluble content with respect to the lubricating oil 3 interposed in the friction surface 2.

Embodiment 3

Further, there is shown the results of an actual device test executed by the inventors with using a four-cycle supercharged diesel six-cylinder engine (1544 kW×800 rpm, D×S=370 mm×540 mm) equipped with the precise filtering means mounted on a training ship, HOKUSEIMARU, of Faculty of Fisheries of Hokkaido University commissioned on October, 1976. In accordance with the result, the lubricating oil nature was kept approximately constant during the operation over 18000 hr in about ten years up to October, 1987 when a secondary intermediate inspection was executed, and the percentage content of the n pentane insoluble content was kept in a fixed value about 0.2 mass %. Since the lubricating oil was kept clean as in the result, the engine was kept clean and a red paint was left in a crank chamber such as just after manufacturing. The wear during the ten years is 0.008 mm/1000 hr in the liner, and 0.014/1000 hr in the ring which correspond to one fifth to one tenth of the normal one.

Embodiment 4

Further, there are shown results obtained by applying an overhaul after the operating time of about 9000 hr to each of four power generating diesel engines having the same type and the same power and equipped with the precise filtering means and a floating high suction mentioned below, and measuring a wear degree of each of the portions, a specific consumption of the lubricating oil and the percentage content of the n pentane insoluble content.

The supply of the fuel oil to the engine in the ship is generally constituted by the system in which the fuel oil is supplied from the bottom portion of the service tank in which the sludge is deposited and accumulated, however, the floating high suction is structured such as to supply the supernatant fuel oil having no sludge to the engine from the upper portion of the service tank, thereby preventing the sludge of the fuel oil from entering into the engine. In accordance with the results of the experiment mentioned above, the wear of the top rings of four engines is between 0.003 and 0.018 mm at 9000 hr close to zero, the wear of the cylinder liner and crank pin bearing is close to zero, the specific consumption of the lubricating oil is about 0.12 g/kW·h corresponding to about one tenth of the normal one, the percentage content of the n pentane insoluble content is maintained at about 0.1%, and an outer appearance thereof is hardly changed from the fresh oil.

DESCRIPTION OF REFERENCE NUMERALS

1. one of two objects
2. friction surface
3. lubricating oil
4. insoluble content
5. shaft
6. semicircular arc shaped metal part
7. bore
8. overlay layer
9. nickel dam layer
10. lead bronze layer

TABLE 1

Allowable value of content of insoluble content in system oil of professional manufacturer companies

| Kind of oil | Insoluble content | A company | B company | C company | D company | E company | F company |
|---|---|---|---|---|---|---|---|
| Regular type | Pentane insoluble content wt % | — | 2.5 | 2.0 | 1.8 | — | — |
| | Benzene insoluble content wt % | — | 2.0 | 1.0 | 1.5 | — | — |
| | Deposition number | 0.5 | — | 0.6 | — | — | — |
| Premium type | Pentane insoluble content wt % | — | 2.5 | — | 1.9 | — | — |
| | Benzene insoluble content wt % | — | 2.0 | — | 1.5 | — | — |
| HD type | Pentane insoluble content wt % | — | 2.5 | — | 1.9 | 2.5 | 3.0 |
| | Benzene insoluble content wt % | — | 2.0 | — | 1.8 | — | — |
| | Deposition number | — | — | — | 0.3 | — | — |

TABLE 2

Results of measurement of wear quantity in friction surface of bore

Unit: mm

| | Item | | | | | | |
|---|---|---|---|---|---|---|---|
| | Entire thickness | | Metal | Groove | Metal wear quantity Reference value- | Residual thickness |
| Position | Micrometer | Measure scope | thickness | depth | groove depth | of alloy portion |
| Sound portion i | 8.38 | 8.385 | 0.73 | 0.035-0.040 | Reference value (0.040) | 0.035-0.040 |

TABLE 2-continued

Results of measurement of wear quantity in friction surface of bore

Unit: mm

| Position | | Item: Entire thickness: Micrometer | Entire thickness: Measure scope | Metal thickness | Groove depth | Metal wear quantity Reference value-groove depth | Residual thickness of alloy portion |
|---|---|---|---|---|---|---|---|
| Wear portion | ii | 8.37 | 8.375 | 0.80 | 0.010-0.015 | 0.025-0.030 | 0.01 |
| | iii | 8.38 | 8.370 | 0.67 | 0.015-0.020 | 0.020-0.025 | 0.005-0.010 |
| | iv | 8.38 | 8.379 | 0.67 | 0.015-0.020 | 0.020-0.025 | 0.010-0.015 |
| | v | 8.38 | 8.371 | 0.70 | 0.015-0.020 | 0.020-0.025 | 0.005-0.010 |
| | vi | 8.37 | 8.368 | 0.70 | 0.015-0.020 | 0.020-0.025 | 0-0.015 |
| | vii | 8.37 | 8.369 | 0.72 | 0.010 | 0.03 | 0-0.005 |
| | viii | 8.37 | 8.371 | 0.83 | 0.010 | 0.03 | 0-0.010 |

What is claimed is:

1. A method of suppressing a wear in a friction system between two objects comprising:

expressing a corresponding value between a maximum rotation speed and a percentage content of an insoluble content as a function of P(n)=p(n) of a maximum rotation speed n and a percentage content p of an insoluble content given by a continuous decreasing curve passing through a plurality of points: a point, at 100 rpm, 0.5 mass %; a point, at 750 rpm, 0.2 mass %; a point, at 1200 rpm, 0.1 mass %; a point, at 3000 rpm, 0.05 mass %; and a point, at 8000 rpm, 0.025 mass % on a graph adopting the maximum rotation speed n as a horizontal axis and the percentage content p of the insoluble content as a vertical axis, and regulating and maintaining the percentage content of the insoluble content with respect to the lubricating oil, using a precise filtering means, within a value range shown by P(n)=p(n)±0.05, including 0.05%, an effective error range as a percentage content P of an insoluble content to a chosen rotation speed, in a friction system in which the lubricating oil is interposed between the two objects for the purpose of suppressing a wear due to an abrasion of a friction surface in a contact periodical relative motion between the two objects, wherein, in P(n)=p(n)±0.05, if P(n)<0, the minimum value of P(n) is a finite minimum value larger than zero, and wherein the precise filtering means comprises a filter element formed by laminating a plurality of thin sheets, wherein the lubricating oil is passed through a paper laminated gap so as to make an impurity having a size equal to or more than 1 μm contained in the lubricating oil to be attached to a paper fiber on the basis of a molecular Brownian motion and be removed.

2. A method of suppressing a wear as claimed in claim 1, wherein the insoluble content is constituted by an n-pentane.

3. A method of suppressing a wear as claimed in claim 1, wherein the friction system between two objects is constituted by a friction system comprising a cylinder and a piston.

4. A method of suppressing a wear as claimed in claim 1, wherein the friction system between two objects is comprised by a friction system comprising a bore and a shaft axially supported by the bore.

5. A method of suppressing a wear as claimed in claim 1, further comprising:

replacing a part or the entire lubricating oil with a fresh oil at the right time when the percentage content of the insoluble content with respect to the lubricating oil deviates from the range given by P(n)=p(n)±0.05%, so as to regulate and maintain the percentage content of the insoluble content within a value range shown by P(n)=p(n)±0.05%.

6. A method of suppressing a wear as claimed in claim 2, wherein the friction system between two objects is constituted by a friction system comprising a cylinder and a piston.

7. A method of suppressing a wear as claimed in claim 2, wherein the friction system between two objects is comprised by a friction system comprising a bore and a shaft axially supported by the bore.

8. A method of suppressing a wear as claimed in claim 2, further comprising:

replacing a part or the entire lubricating oil with a fresh oil at the right time when the percentage content of the insoluble content with respect to the lubricating oil deviates from the range given by P(n)=p(n)±0.05% so as to regulate and maintain the percentage content of the insoluble content within a value range shown by P(n)=p(n)±0.05%.

9. A method of suppressing a wear as claimed in claim 3, further comprising:

replacing a part or the entire lubricating oil with a fresh oil at the right time when the percentage content of the insoluble content with respect to the lubricating oil deviates from the range given by P(n)=p(n)±0.05%, so as to regulate and maintain the percentage content of the insoluble content within a value range shown by P(n)=p(n)±0.05%.

10. A method of suppressing a wear as claimed in claim 4, further comprising:

replacing a part or the entire lubricating oil with a fresh oil at the right time when the percentage content of the insoluble content with respect to the lubricating oil deviates from the range given by P(n)=p(n)±0.05%, so as to regulate and maintain the percentage content of the insoluble content within a value range shown by P(n)=p(n)±0.05%.

* * * * *